United States Patent [19]

Kobayashi et al.

[11] Patent Number: 4,888,571

[45] Date of Patent: Dec. 19, 1989

[54] COIL MEANS

[75] Inventors: Osamu Kobayashi, Ichikawa; Satoshi Miyagi, Tokyo; Kazuyoshi Hanabusa, Chiba, all of Japan

[73] Assignee: TDK Corporation, Tokyo, Japan

[21] Appl. No.: 347,581

[22] Filed: May 5, 1989

[30] Foreign Application Priority Data

May 7, 1988 [JP] Japan ..... 63-60419

[51] Int. Cl.[4] ..... H01F 15/02

[52] U.S. Cl. ..... 336/65; 336/83; 336/192

[58] Field of Search ..... 336/65, 83, 92, 212, 336/192, 233

[56] References Cited

U.S. PATENT DOCUMENTS 3,859,614 1/1975 Reithmaier ..... 336/83

4,656,450 4/1987 Jarosz et al. ..... 336/83

*Primary Examiner*—Thomas J. Kozma

*Attorney, Agent, or Firm*—Fleit, Jacobson, Cohn, Price, Holman & Stern

[57] ABSTRACT

A coil assembly having a drum core for winding a coil wire. The drum core has a drum portion and a pair of end flanges provided at the opposite ends of the drum portion. The wire is wound on the drum portion. The drum core is encircled by a cylindrical ring core. The drum core and the ring core are supported by a base plate which has a recess for receiving end portions of the drum core and the ring core for appropriately locating the drum core and the ring core during assembling. The ring core is formed with cutouts leaving projecting edges at the end adjacent to the base plate. The base plate is provided with terminals at the edge portions adjacent to the cutouts of the ring core. End portions of the coil wire are passed through the cutouts and connected with the terminals.

5 Claims, 5 Drawing Sheets

COIL MEANS

BACKGROUND OF THE INVENTION

1. Field of the Invention

The present invention relates to coil means having a drum core for winding a coil wire and a ring core encircling the drum core, the drum core and the ring core being supported on a base.

2. Description of the Prior Art

A conventional coil means which may be used in a transformer includes a drum core having a drum portion and a pair of flanges provided at the opposite ends of the drum portion. A coil wire or coil wires are wound around the drum portion and a ring core is provided to encircle the drum core and the wire or wires wound around the drum core. The drum core with the coil wire and the ring core are supported at one ends by a base plate which made of a non:magnetic material such as a plastic material. The drum core and the ring core are then adhesively attached to the base plate.

It has been experienced in this type of coil means that locating and assembling the drum core and the ring core on the base plate are not convenient. Since the ends of the drum core and the ring core are simply placed on a flat surface of the base plate, the drum core may be displaced on the surface of the base plate during assembling. This may cause a difficulty in fitting the ring core in position. If the ring core is nevertheless fitted forcibly, there may be a possibility that the drum core and/or ring core may be damaged resulting in a change in the magnetic property of the coil means.

It should further be pointed out that in this type of coil means coil wire ends may be put between the ring core and the periphery of the flange of the drum core and may sometimes be cut during the assembling operation. A further problem encountered in this known type of coil means is that it was difficult to make the coil means sufficiently small in height.

SUMMARY OF THE INVENTION

It is therefore an object of the present invention to provide coil means which is convenient to assemble.

A further object of the present invention is to provide coil means which can eliminate possibility of the drum core being displaced on the base plate and in which the drum core can readily be located.

Still further object of the present invention is to provide coil means in which possibility of coil wire being put between the ring core and the drum core flange can substantially be decreased.

Yet further object of the present invention is to provide a coil structure which is effective to decrease the height of the structure.

According to the present invention, at least a part of the above and other objects can be accomplished by providing the base plate with recess means on the surface supporting the ends of the drum core and the ring core for locating the drum core and the ring core. More specifically, the present invention provides coil means including a drum core having a drum portion and a pair of flanges provided at the opposite ends of the drum portion, at least one coil wire wound around the drum portion of the drum core, a ring core of a cylindrical configuration placed to encircle the drum core and the coil wire wound around the drum core, a base plate having a surface for supporting one ends of said drum core and said ring core, said ring core being formed at said one end with at least one cutout leaving at least one projecting edge at said one end, said base plate being formed at said surface with recess means for receiving the flange at said one end of the drum core and for receiving said projecting edge of the ring core, said base plate being provided with terminal means at a portion adjacent to the cutout of the ring core, said wire being passed through said cutout of the ring core and connected at each ends to said terminal.

According to the present invention, the drum core is properly located on the base plate through the recess means so that it is not likely to be displaced during assembling the drum core on the base plate. The ring core is also properly located on the base plate so that the assembling work can significantly be improved. By placing the drum core and the ring core in the recess means, it is possible to decrease the height of the coil means. Since the wire is passed through the cutout in the ring core, it is unlikely that the wire is put between the ring core and the flange of the drum core to an extent that it is eventually cut. The location of the terminals on the base plate makes it convenient to connect the wire ends to the terminals.

The above and other objects and features of the present invention will become apparent from the following description of a preferred embodiment taking reference to the accompanying drawings.

DESCRIPTION OF THE PRIOR ART

Figure 6:
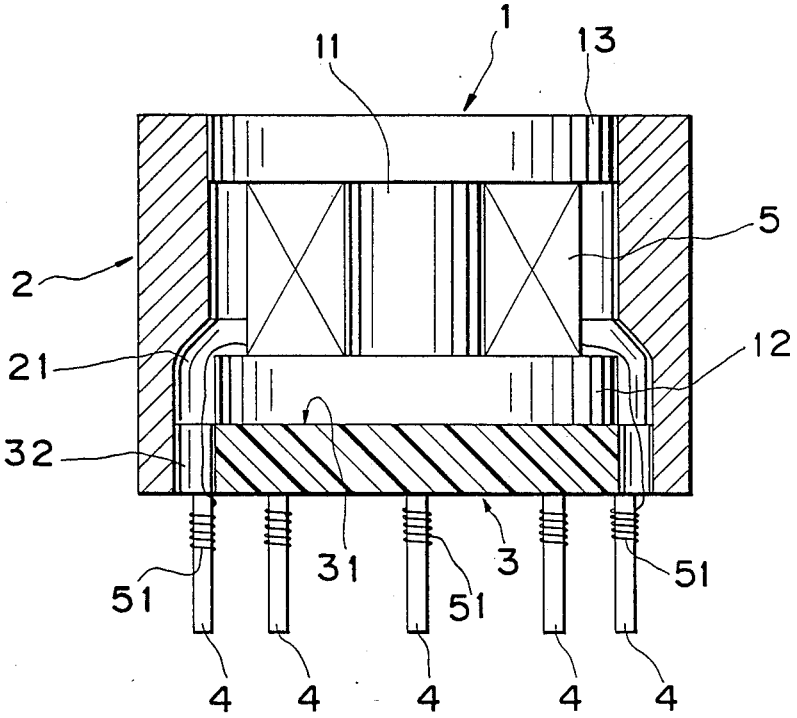
FIG. 6 (PRIOR ART)
FIG. 6 is a sectional view similar to FIG. 3 but showing a conventional structure.

Referring first to FIG. 6 which shows a conventional structure, there is provided a drum core 1 having a drum portion 11 and a pair of flanges 12 and 13 provided at the opposite ends of the drum portion 11. Coil wires 5 are wound around the drum portion 11 of the drum core 1. A ring core 2 of cylindrical configuration is provided and located to encircle the drum core 1 having the coil wires 5 wound therearound. A base plate 3 of a non-magnetic material such as plastic material is provided to support the drum core 1 and the ring core 2. The base plate 3 has a surface 31 on which one end of the drum core 1 and one end of the ring core are placed. The ends of the drum core 1 and the ring core 2 are adhesively attached to the base plate 3. On the other surface of the base plate 3, there are provided an appropriate number of terminals 4. The ring core 2 is formed at the inner surface of the end portion adjacent to the base plate 3 with grooves 21. The base plate 3 is also formed with cutouts 32 at portions corresponding to the grooves 21 in the ring core 2. The coil wires 5 have end portions 51 which are passed through the grooves 21 and the cutouts 32 and connected with respective ones of the terminals 4. The conventional structure described above has disadvantages already described.

FIGS. 1 through 5 show one embodiment of the present invention. As shown, the coil assembly of the present invention includes a drum core 1 having a drum portion 11 and a pair of flanges 12 and 13 as in the case of the aforementioned conventional structure. An appropriate number of coils 5 are wound around the drum portion 11. The drum core 1 and the coil wires 5 are encircled by a ring core 2 as in the conventional structure. The drum core 1 and the ring core 2 are supported on a surface 31 of a base plate 3 which is made of a non-magnetic material such as a plastic material.

Figure 2:
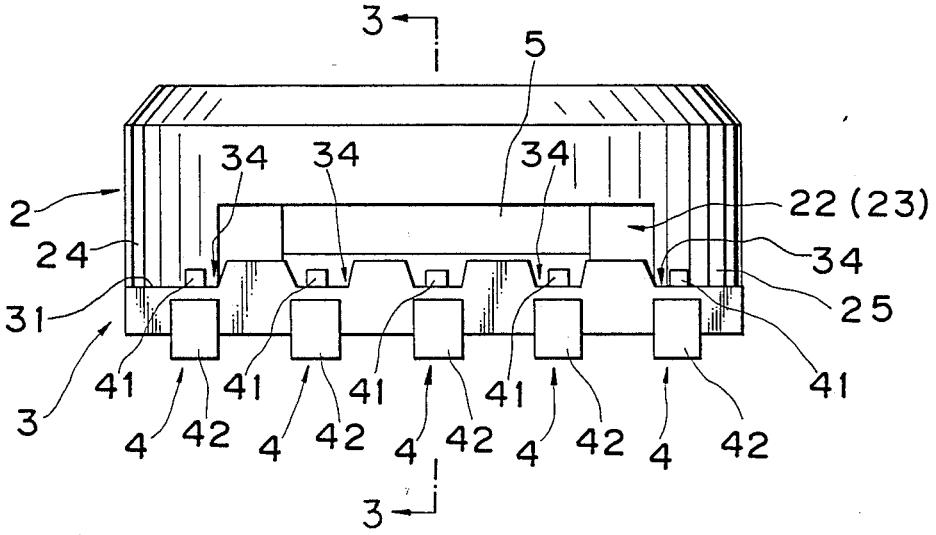
FIG. 2 is a side view of the coil assembly shown in FIG. 1.
Figure 3:
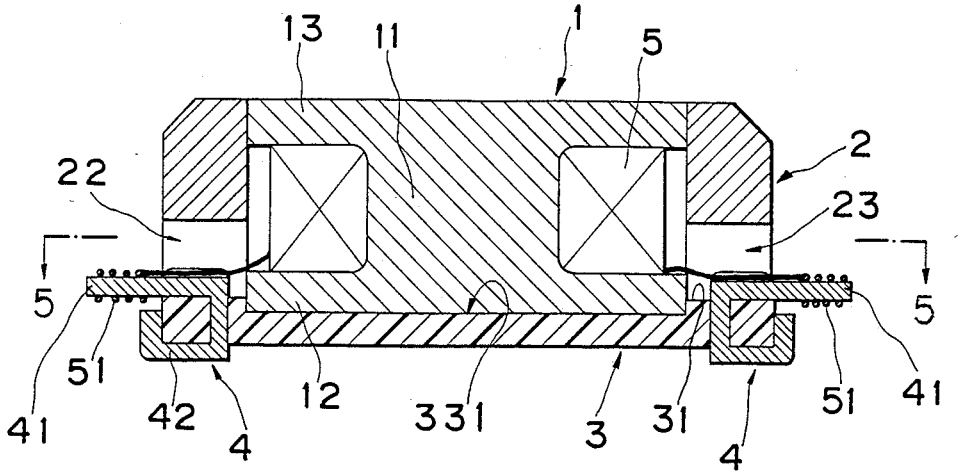
FIG. 3 is a sectional view taken along the line III—III in FIG. 2.
Figure 5:
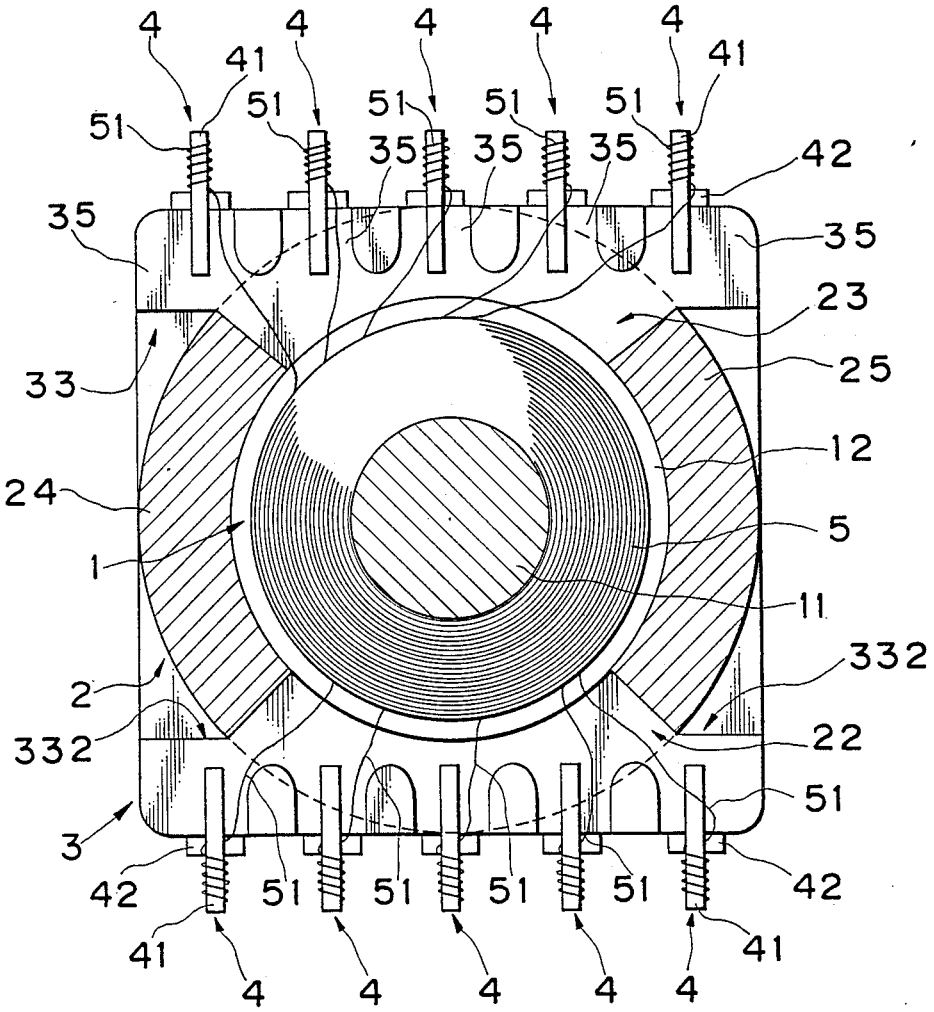
FIG. 5 is a sectional view taken along the line V—V in FIG. 3.

According to the features of the present invention, the ring core 2 is formed at diametrically opposite positions of an end portion adjacent to the base plate 3 with a pair of cutouts 22 and 23 as shown in FIGS. 2, 3 and 5. Between the cutouts 22 and 23, there are defined projecting edges 24 and 25 as shown in FIG. 2. In FIG. 3, it will be noted that the depth of the cutout 22 or 23 is greater than the thickness of the flange 12 which is to be attached to the base plate 3. The ring core 2 therefore encircles the flange 12 of the drum core 1 at the projecting edges 24 and 25 whereby a substantially closed magnetic path is formed through the flange 12 and the projecting edges 24 and 25 of the ring core 2. The cutouts 22 and 23 are determined to have lengths which do not have any adverse effect on the characteristics of the coil assembly.

Figure 1:
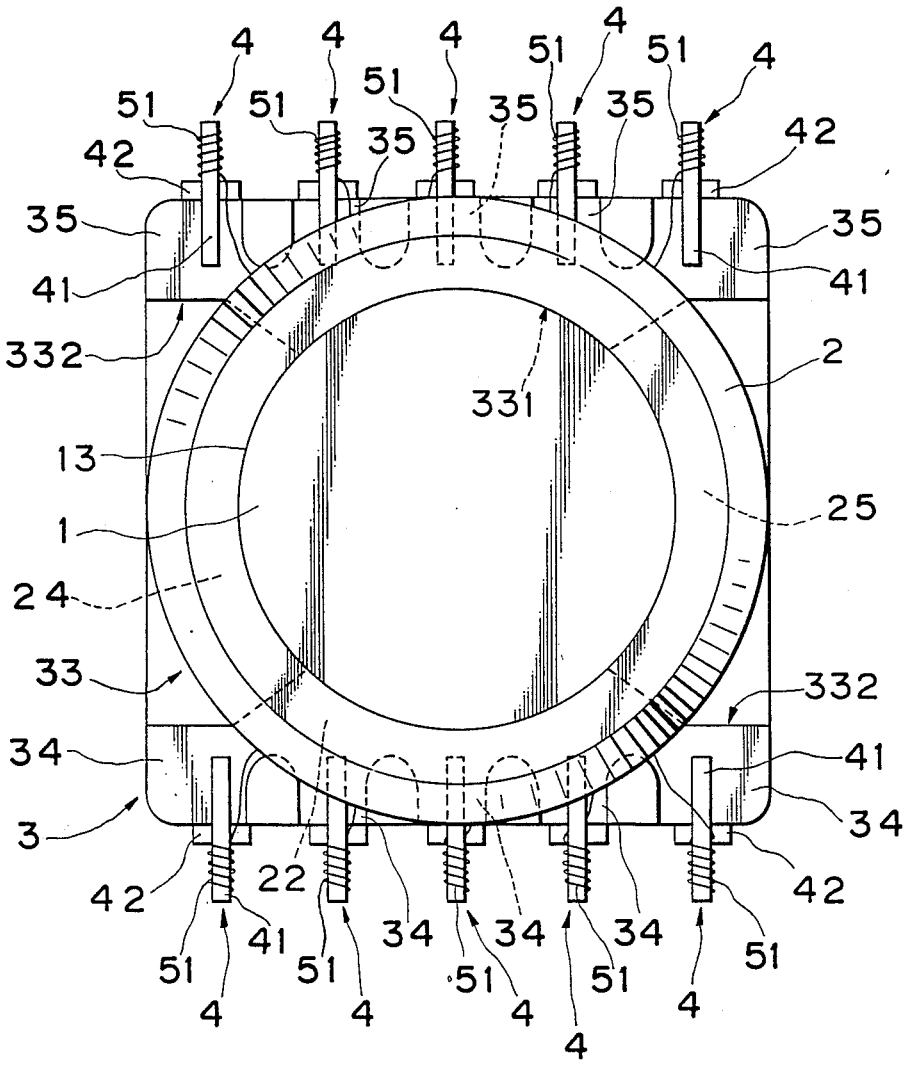
FIG. 1 is a plan view of a coil assembly in accordance with one embodiment of the present invention.
Figure 4:
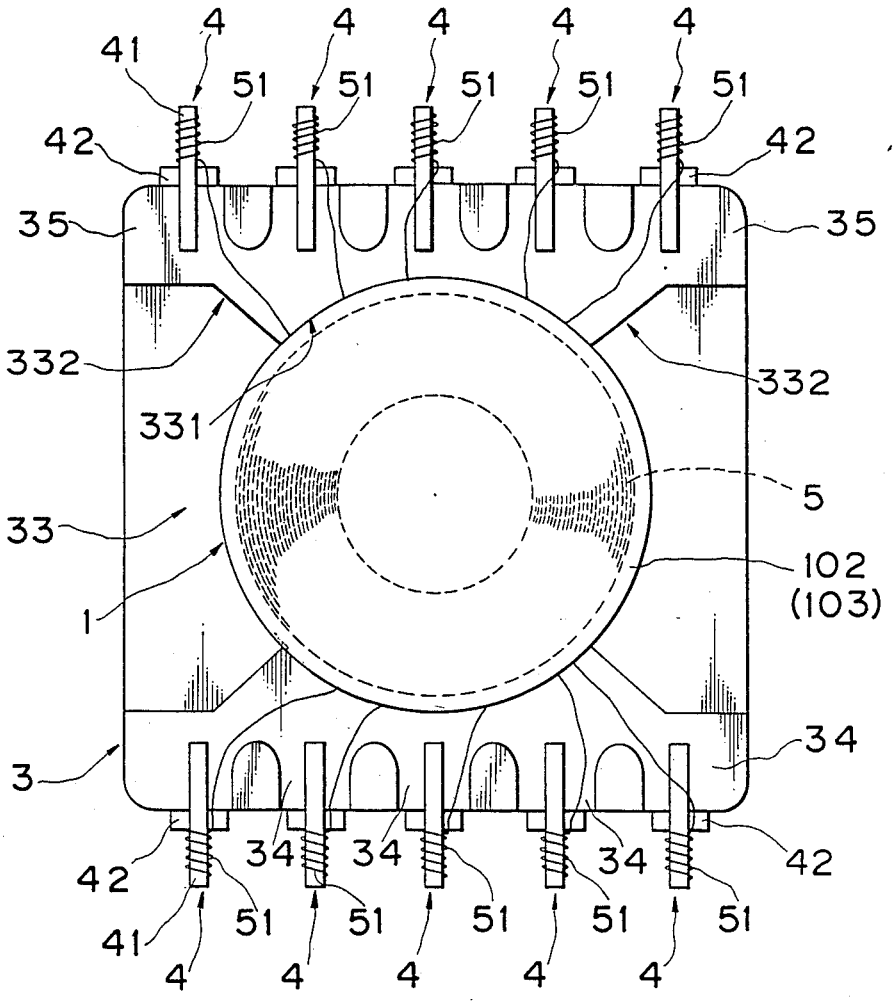
FIG. 4 is a plan view of the coil assembly with the ring core removed.

The base 3 is made of an electrically insulative material such as a plastic material and has a square plan shape as shown in FIGS. 1, 4 and 5. Between the opposite peripheries of the square, the base plate 3 is formed at the surface 31 with a recess 33. The recess 33 is formed by a pair of annular shoulders 331 located along a circle having a diameter corresponding to the diameter of the flange 12 of the drum core 1 and two pairs of substantially straight shoulders 332 which extend substantially diametrically. In each pair, the shoulders 332 are circumferentially spaced so that the projecting edge 24 or 25 can be accommodated at the groove 33.

In assembling operation, the drum core 1 is first placed on the base plate 3 so that the flange 12 of the drum core 1 is fitted to the shoulders 331 of the groove 33. The ring core 2 is then placed on the base plate 3 so that the projecting edges 24 and 25 are fitted to the shoulders 332. It will therefore be understood that the drum core 1 and the ring core 2 are properly located on the base plate 3. It should further be noted that the positions of the drum core 1 and the ring core 2 can be lowered to an extent corresponding to the depth of the groove 33 so that it is possible to decrease the height of the coil assembly thus formed.

According to a further feature of the present invention, the base plate 3 is provided with an appropriate number of terminals 41 on peripheries adjacent to the cutouts 22 and 23. As shown in FIG. 3, each of the terminals 41 are inserted through an aperture formed in the base plate 3 for the purpose and bent around the edge of the base plate as shown by a reference numeral 42 at one end portion, the other end portion being folded over the base plate 3 and extending diametrically outwardly to form the terminal. End portions 51 of the coil wires 5 are passed through the cutouts 22 and 23 of the ring core 2 and connected with respective ones of the terminals 41 by means for example of soldering.

The invention has thus been shown and described with reference to a specific embodiment, however, it should be noted that the invention is in no way limited to the details of the illustrated structures but changes and modifications may be made without departing from the scop of the appended claims.

I claim:

1. Coil means including a drum core having a drum portion and a pair of flanges provided at the opposite ends of the drum portion, at least one coil wire wound around the drum portion of the drum core, a ring core of a cylindrical configuration placed to encircle the drum core and the coil wire wound around the drum core, a base plate having a surface for supporting one of the ends of said drum core and said ring core, said ring core being formed at said one end with at least one cutout leaving at least one projecting edge at said one end, said base plate being formed at said surface with recess means for receiving the flange at said one end of the drum core and for receiving said projecting edge of the ring core.

2. Coil means in accordance with claim 1 in which said base plate is provided with terminal means at a portion adjacent to the cutout of the ring core, said wire being passed through said cutout of the ring core and connected at each ends to said terminal means.

3. Coil means in accordance with claim 2 in which said terminal means includes a plurality of terminals each extending radially outwardly of the base plate.

4. Coil means including a drum core having a drum portion and a pair of flanges provided at the opposite ends of the drum portion, at least one coil wire wound around the drum portion of the drum core, a ring core of a hollow configuration placed to encircle the drum core and the coil wire wound around the drum core, a base plate having a surface for supporting one of the ends of said drum core and said ring core, said ring core being formed at said one end with at least one cutout leaving at least one projecting edge at said one end, said base plate being formed at said surface with recess means defining first shoulder means for receiving the flange at said one end of the drum core and second shoulder means for receiving said projecting edge of the ring core.

5. Coil means in accordance with claim 4 in which said flange at said one end of the drum core is of a circular configuration and said first shoulder means is of an annular shape located along a circle having a diameter corresponding to a diameter of the flange at said one end of the drum core.

* * * * *